US011013387B2

(12) United States Patent
Khalil

(10) Patent No.: US 11,013,387 B2
(45) Date of Patent: May 25, 2021

(54) VACUUM CLEANER

(71) Applicant: David Khalil, College Park, MD (US)

(72) Inventor: David Khalil, College Park, MD (US)

(73) Assignee: Techtronic Floor Care Technology Limited, Tortola (VG)

( * ) Notice: Subject to any disclaimer, the term of this patent is extended or adjusted under 35 U.S.C. 154(b) by 187 days.

(21) Appl. No.: 16/428,583

(22) Filed: May 31, 2019

(65) Prior Publication Data

US 2019/0365178 A1 Dec. 5, 2019

Related U.S. Application Data

(60) Provisional application No. 62/678,537, filed on May 31, 2018.

(51) Int. Cl.

| | |
|---|---|
| ***A47L 9/28*** | (2006.01) |
| ***A47L 5/28*** | (2006.01) |
| ***A47L 9/32*** | (2006.01) |

(52) U.S. Cl.

CPC ..... *A47L 9/2884* (2013.01); *A47L 5/28* (2013.01); *A47L 9/325* (2013.01)

(58) Field of Classification Search

CPC ... A47L 5/225; A47L 5/24; A47L 5/28; A47L 5/30; A47L 9/2873; A47L 9/2884; A47L 9/325

See application file for complete search history.

(56) References Cited

U.S. PATENT DOCUMENTS

| | | | | |
|---|---|---|---|---|
| 6,536,073 | B2 | 3/2003 | Uratani et al. | |
| 6,608,466 | B2 | 8/2003 | Riley | |
| 7,345,437 | B2 | 3/2008 | Baer et al. | |
| 7,712,182 | B2 * | 5/2010 | Zeiler | A47L 9/009 15/353 |
| 8,365,350 | B2 | 2/2013 | Cochran et al. | |
| 8,375,507 | B2 * | 2/2013 | Lee | A47L 9/26 15/323 |
| 8,479,964 | B2 * | 7/2013 | Furusawa | A47L 9/2884 227/10 |
| 8,601,640 | B2 * | 12/2013 | Bertram | A47L 9/00 15/327.2 |
| 8,806,702 | B2 | 8/2014 | Wolfe, Jr. et al. | |

(Continued)

FOREIGN PATENT DOCUMENTS

| | | |
|---|---|---|
| CN | 1323564 A | 11/2001 |
| CN | 2584116 Y | 11/2003 |

(Continued)

*Primary Examiner* — Marc Carlson

(74) *Attorney, Agent, or Firm* — Michael Best & Friedrich LLP

(57) ABSTRACT

A vacuum cleaner comprising a housing, a suction source, a dirt collection chamber in fluid communication with the suction source, a battery to provide power to the suction source, and a plug assembly having a body and an electrical connector in electrical communication with the battery via a cord. The plug assembly is configured to receive power from an AC power source to charge the battery. The plug assembly is moveable between a first position, in which the plug assembly is outside the housing and a second position in which the plug assembly is received in the housing. When the plug assembly is in the second position, the body of the plug assembly forms an outer surface of the housing.

26 Claims, 10 Drawing Sheets

(56) References Cited

U.S. PATENT DOCUMENTS

| | | | | |
|---|---|---|---|---|
| 9,101,252 | B2 | 8/2015 | Conrad | |
| 9,119,513 | B2 | 9/2015 | Conrad | |
| 9,192,269 | B2 | 11/2015 | Conrad | |
| 9,204,773 | B2 | 12/2015 | Conrad | |
| 9,265,393 | B2 | 2/2016 | Frank et al. | |
| 9,295,363 | B1 | 3/2016 | Conrad | |
| 9,420,929 | B2 | 8/2016 | Hensel et al. | |
| 9,427,126 | B2 | 8/2016 | Conrad | |
| 2005/0155177 | A1* | 7/2005 | Baer | A47L 5/365 15/353 |
| 2005/0236012 | A1* | 10/2005 | Josefsson | B08B 3/026 134/1 |
| 2005/0273969 | A1 | 12/2005 | Watson et al. | |
| 2006/0137129 | A1* | 6/2006 | Schroter | A47L 9/327 15/323 |
| 2006/0196688 | A1* | 9/2006 | Robertson | B65H 75/04 174/135 |
| 2007/0226947 | A1 | 10/2007 | Kang | |
| 2007/0251048 | A1* | 11/2007 | Choi | A47L 5/225 15/329 |
| 2008/0172821 | A1 | 7/2008 | Kang et al. | |
| 2009/0000054 | A1 | 1/2009 | Hampton et al. | |
| 2009/0083932 | A1 | 4/2009 | Henderson | |
| 2010/0325832 | A1* | 12/2010 | Yoo | A47L 9/28 15/323 |
| 2011/0239398 | A1* | 10/2011 | Furusawa | A47L 9/2884 15/339 |
| 2013/0239360 | A1 | 9/2013 | Hensel et al. | |
| 2014/0245562 | A1 | 9/2014 | Conrad | |
| 2015/0366425 | A1 | 12/2015 | Lee et al. | |
| 2016/0066755 | A1 | 3/2016 | Conrad | |
| 2016/0088991 | A1 | 3/2016 | Lee et al. | |
| 2016/0095488 | A1 | 4/2016 | Lee et al. | |
| 2016/0198916 | A1 | 7/2016 | Conrad | |
| 2016/0213213 | A1 | 7/2016 | Conrad | |
| 2020/0274382 | A1* | 8/2020 | Conrad | A47L 9/2894 |

FOREIGN PATENT DOCUMENTS

| | | | |
|---|---|---|---|
| CN | 204427941 | U | 7/2015 |
| CN | 105030160 | A | 11/2015 |
| CN | 204995377 | U | 1/2016 |
| EP | 2895045 | A1 | 7/2015 |
| KR | 200154076 | Y1 | 8/1999 |
| WO | 2005099547 | A1 | 10/2005 |
| WO | 2014040785 | A1 | 3/2014 |
| WO | 2014131104 | A1 | 9/2014 |

* cited by examiner

VACUUM CLEANER

CROSS-REFERENCE TO RELATED APPLICATIONS

This application claims priority to U.S. Provisional Patent Application No. 62/678,537, filed May 31, 2018, the entire contents of which are hereby incorporated by reference herein.

FIELD OF THE INVENTION

The present invention relates to vacuum cleaners, and more particularly to battery powered vacuum cleaners.

BACKGROUND OF THE INVENTION

Battery powered vacuum cleaners use a plug that plugs into an AC power source to charge the battery. The plug converts the AC power from the AC power source to DC power to charge the battery.

SUMMARY OF THE INVENTION

A vacuum cleaner comprising a housing, a suction source, a dirt collection chamber in fluid communication with the suction source, a battery to provide power to the suction source, and a plug assembly having a body and an electrical connector in electrical communication with the battery via a cord. The plug assembly is configured to receive power from an AC power source to charge the battery. The plug assembly is moveable between a first position in which the plug assembly is outside the housing and a second position in which the plug assembly is received in the housing. When the plug assembly is in the second position, the body of the plug assembly forms an outer surface of the housing.

A battery powered cleaner comprising a housing including a handle, a suction source, a suction inlet fluidly coupled to the suction source, a dirt collection chamber, a battery to provide power to the suction source, and a plug assembly having a body and an electrical connector in electrical communication with the battery via a cord. The plug assembly is configured to receive power from an AC power source to charge the battery. The plug assembly is moveable between a first position in which the plug assembly is outside the handle and a second position in which the plug assembly is received in the handle. When the plug assembly is in the second position, the body of the plug assembly forms an outer surface of the handle.

A battery powered cleaner comprising a housing, a motor operably positioned within the housing, a battery to provide power to the motor, and a plug assembly having a body and an electrical connector in electrical communication with the battery via a cord. The plug is configured to engage an AC power source to receive AC power and charge the battery. The plug assembly is moveable between a first position in which the plug assembly is outside of the housing and a second position in which the plug assembly is received in the housing. The housing defines a recess having an access opening, the recess configured to receive the cord and plug assembly in the second position. The plug assembly includes a power converter in the body in electrical communication with the electrical connector configured to convert AC power from the AC power source to DC power to charge the battery. The plug assembly is connected to a distal end of the cord.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
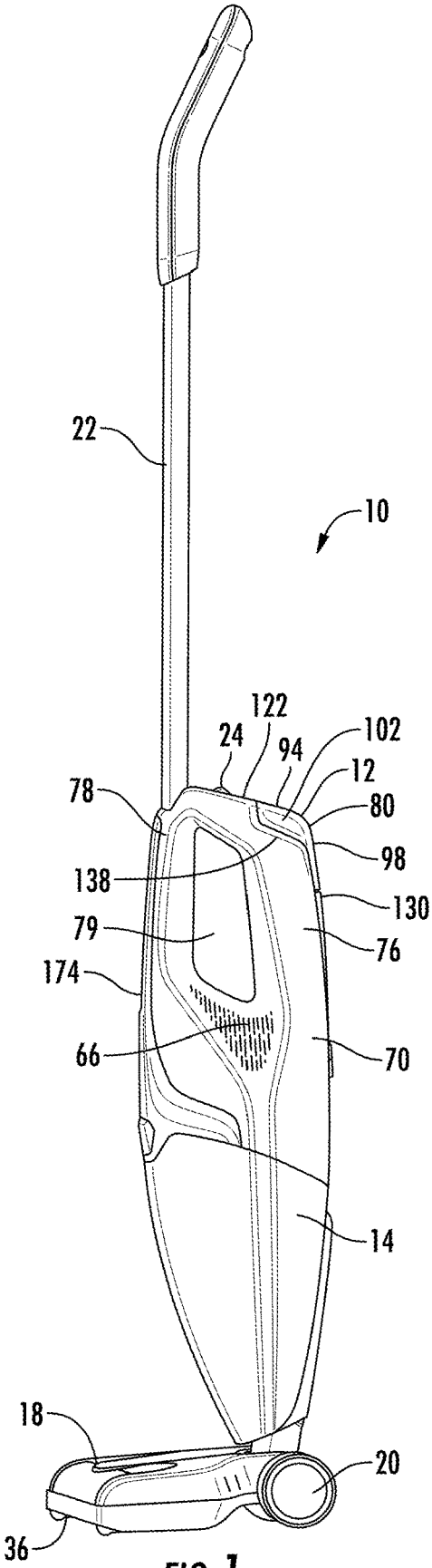
FIG. 1 is a perspective view of a vacuum cleaner.
Figure 2:
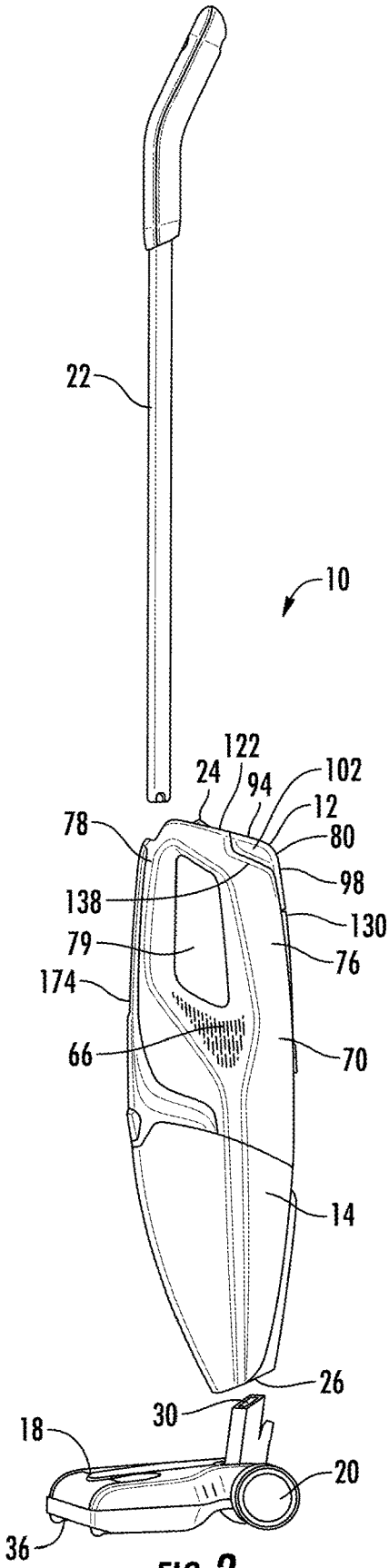
FIG. 2 is an exploded view of the vacuum cleaner of FIG. 1.

FIG. 1 illustrates a vacuum cleaner 10. As explained in further detail below, the vacuum cleaner 10 includes a plug assembly 12 that can move between a first position in which the plug 12 is outside the vacuum cleaner 10 and a second position, shown in FIGS. 1-4, 6, 7 and 9, in which the plug 12 is received in a housing 70 of the vacuum cleaner 10. In the illustrated embodiment, the plug assembly 12 includes a pair of electrical connectors 16 and when the plug 12 is in the second position, the electrical connectors 16 are concealed within the vacuum cleaner 10, keeping them from protruding from the vacuum cleaner 10, and providing a smooth aesthetically pleasing appearance to the vacuum. Also, because the plug 12 is received in the vacuum cleaner 10 and remains attached in the second position it is less likely to be misplaced by an operator.

In the illustrated embodiment, the vacuum cleaner 10 includes a handheld cleaner 14, a foot 18 that rolls on wheels 20, and an upright handle 22. In the embodiment shown in FIG. 2, the upright handle 22 is selectively removable from the handheld cleaner 14 via a release actuator 24 and the handheld cleaner 14 is selectively removable from the foot 18 via mating handheld inlet and foot outlet apertures 26, 30 respectively on the handheld cleaner 14 and foot 18. In the embodiment shown in FIG. 3, the foot 18 includes a brush-roll 34 positioned adjacent an air inlet 36 and a suction conduit 38 that fluidly communicates dirty air from the air inlet 36 to the foot outlet aperture 30 when the foot 18 is attached. In the illustrated embodiment, the handheld cleaner 14 includes a suction conduit 42 leading from the handheld inlet aperture 26 to a dirt collection chamber 46.

The handheld cleaner 14 also includes a suction source 50, which includes a motor 54 that drives a fan 58 to create airflow through the vacuum cleaner 10. The suction source 50 of the illustrated embodiment is operable to create a suction airflow to draw dirty air from a surface into the air inlet 36, through the foot 18, through the suction conduits 38, 42, into the dirt collection chamber 46, through a filter 62, through the suction source 50, and then out a plurality of exhaust vents 66 on the housing 70 of the vacuum cleaner 10. The suction source 50 is powered by one or more rechargeable batteries 74. In some embodiments, the one or more rechargeable batteries 74 are a rechargeable battery pack. In such an embodiment, the rechargeable battery pack may be removable from the vacuum cleaner 10. The removable battery pack may be configured to be recharged when removed from the vacuum cleaner 10, recharged when installed in the vacuum cleaner 10, or both.

In the embodiment shown in FIGS. 1-4, the housing 70 on the handheld cleaner 14 includes a handle portion 76. The handle portion 76 includes a handle grip 78 adjacent an opening 79 for an operator's fingers.

The handheld cleaner 14 includes the plug assembly 12 that receives power from an AC power source to charge the one or more batteries 74 via a cord 82. The cord 82 has a proximal end 84 connected to the cleaner 14 and a distal end 85 including the plug assembly 12. The plug assembly 12 includes a body 80 and the electrical contacts 16. In some embodiments, the plug assembly 12 includes a power converter in the body 80 in electrical communication with the electrical connector 16 and configured to convert AC power from the AC power source to DC power to charge the one or more batteries 74. In other embodiments, the power converter is within the housing 70. In still other embodiments, the power converter is on an AC power charging source that the plug 12 mates with.

The plug assembly 12 is moveable between the first position, in which the plug 12 is outside the housing 70, to the second position shown in FIGS. 1-4, 6, 7 and 9, in which the plug assembly 12 is received in the housing 70. The plug assembly 12 is received within a recess 86 (FIG. 8) having an access opening 87 defined by the housing 70. In the illustrated embodiment, the recess 86 is in or near the handle portion 76 but in other embodiments, the recess 86 can be defined elsewhere on the housing 70. In other alternatives, the plug assembly 12 is received in a housing other than a body housing such as illustrated by housing 70. In such alternatives, the plug assembly 12 is received in a housing forming the foot of the cleaner, or a housing forming the upright handle portion of the cleaner, or in other suitable housings used in various applications.

Figure 3:
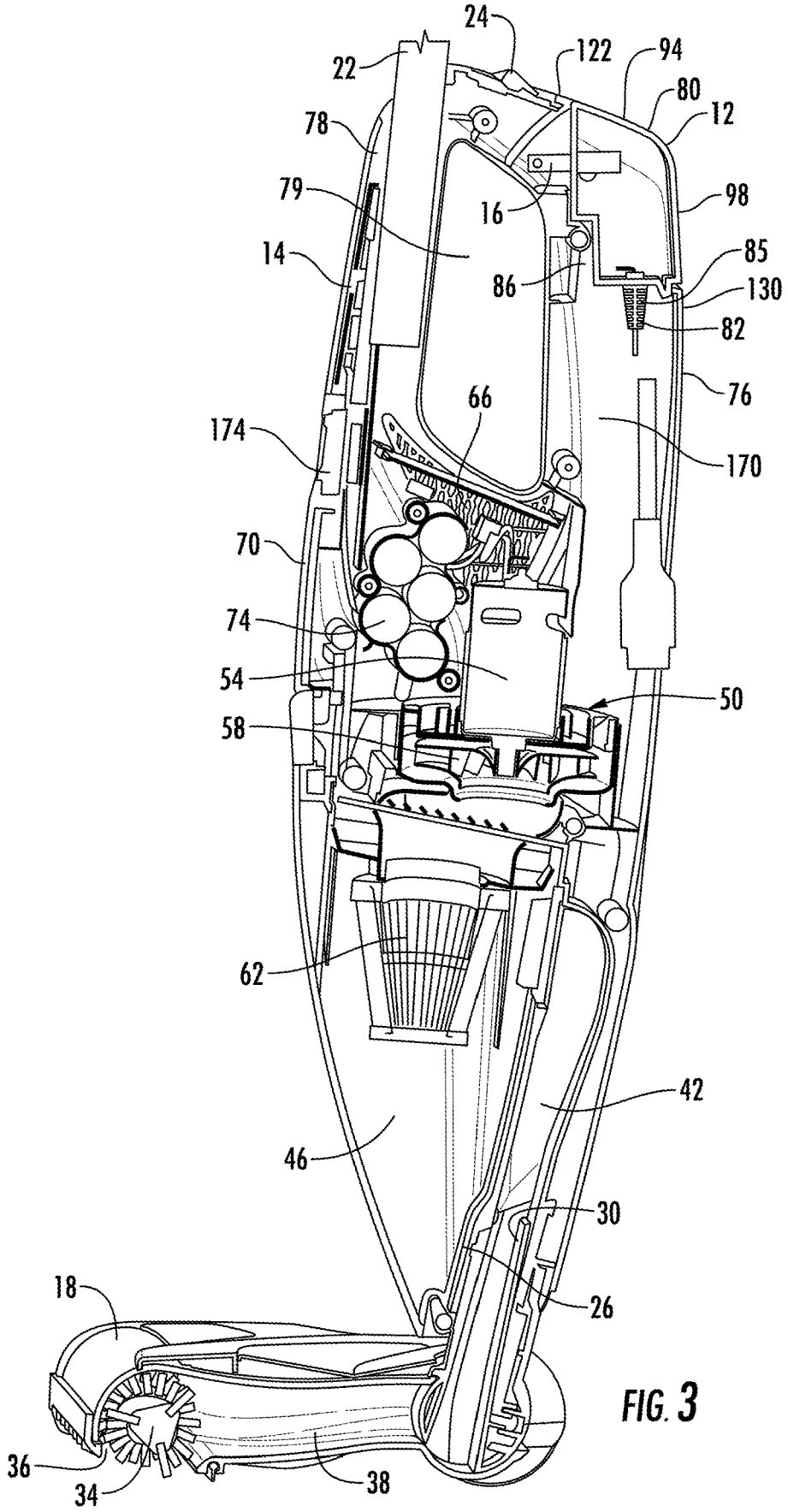
FIG. 3 is a cross-sectional view of the vacuum cleaner of FIG. 1.
Figure 4:
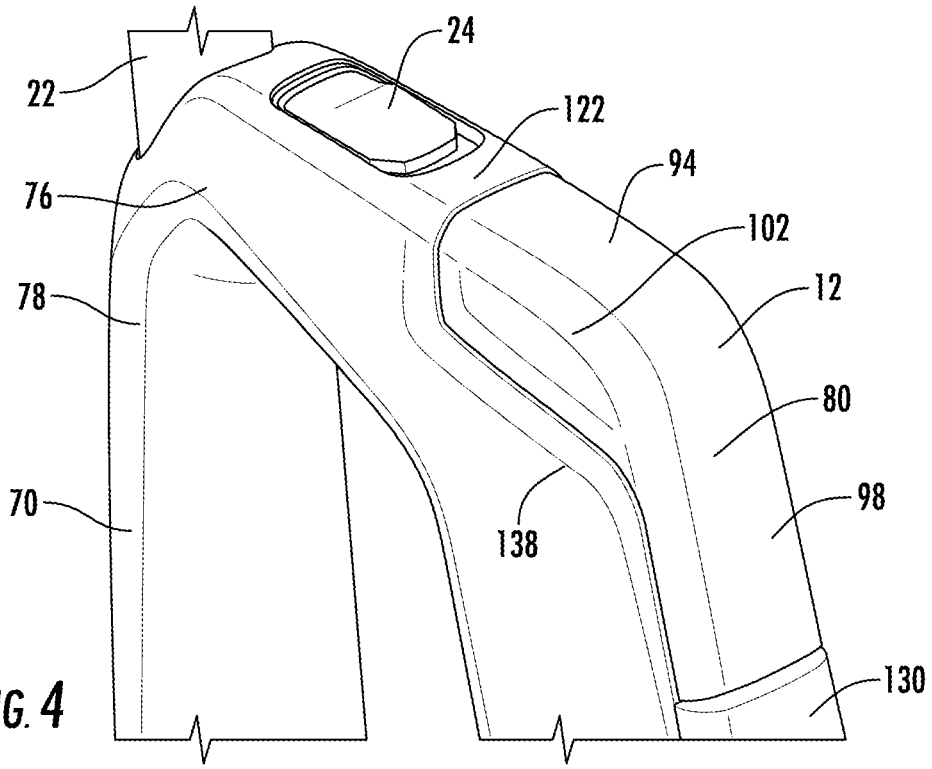
FIG. 4 is an enlarged perspective view of the vacuum cleaner of FIG. 1.
Figure 5:
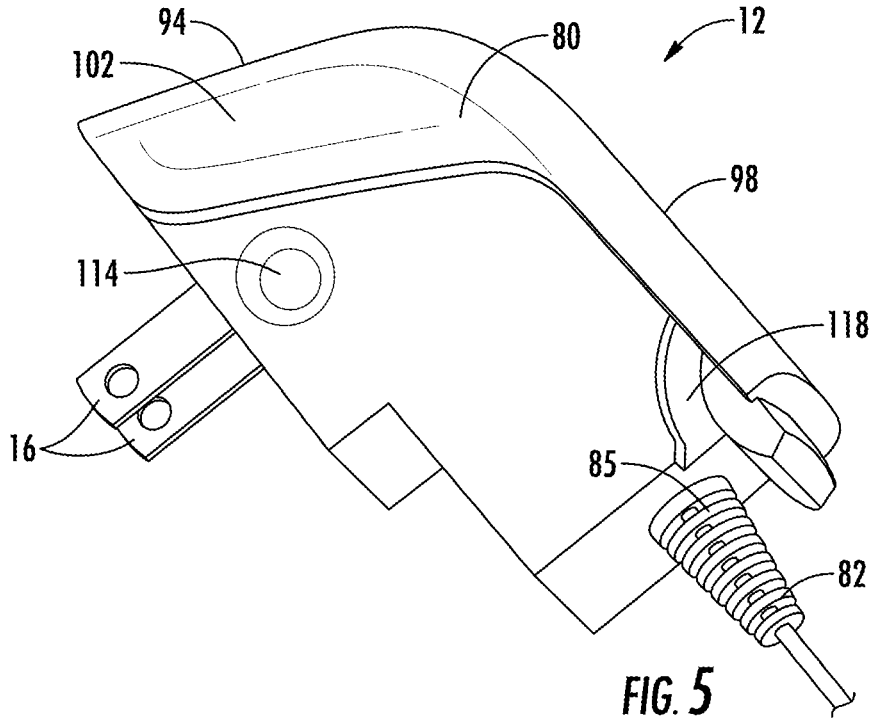
FIG. 5 is a perspective view of a plug of the vacuum cleaner of FIG. 1.
Figure 9:
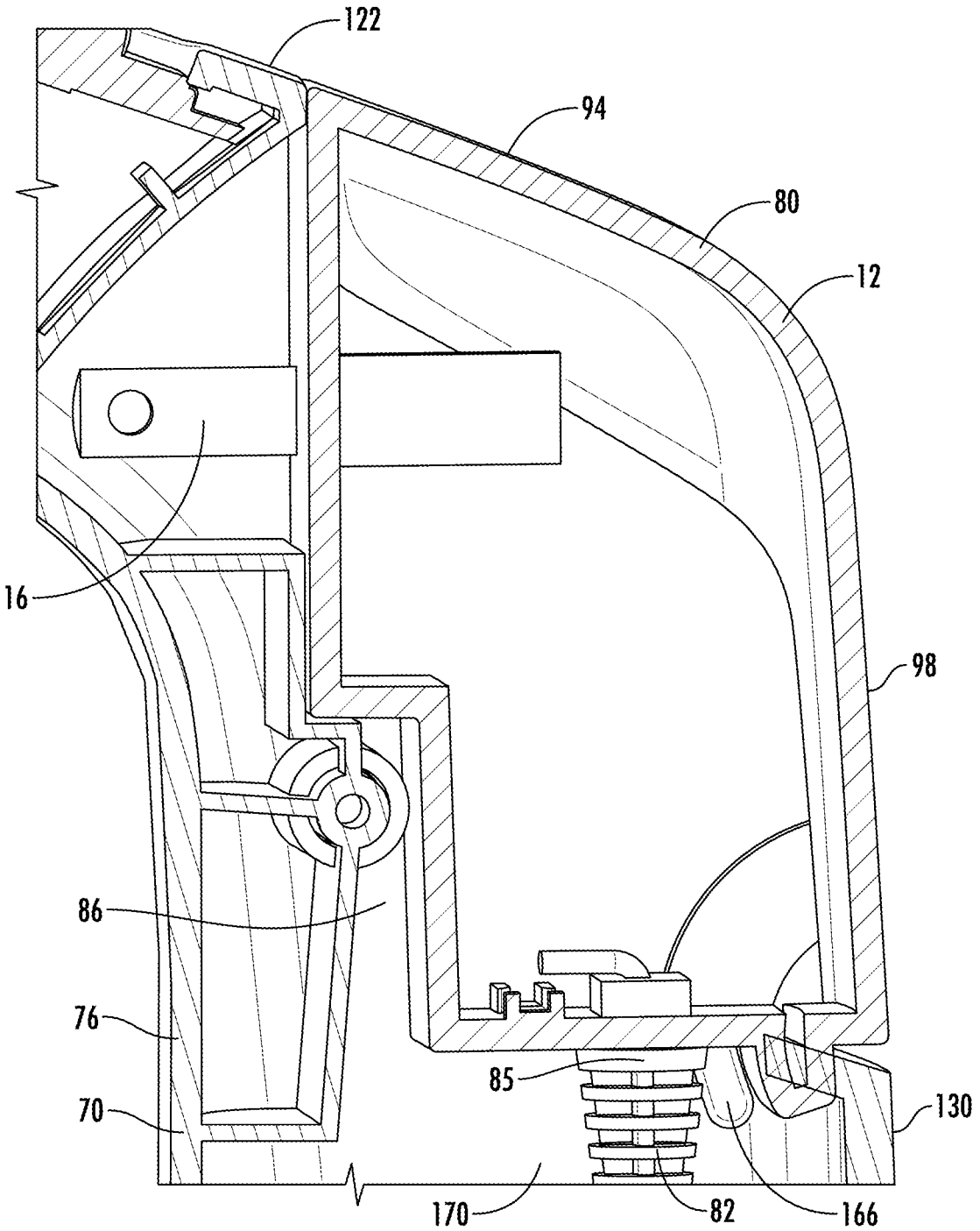
FIG. 9 is a cross-sectional view of the vacuum cleaner of FIG. 1.

In the embodiment shown in FIG. 5, the electrical connector 16 of the plug assembly 12 are AC-style prongs to engage an AC power source, such as a household AC socket, to receive AC power to charge the one or more batteries 74. As shown in FIGS. 1-4, 6, 7 and 9, when the plug 12 is in the second position, the electrical connectors 16 are concealed within the housing 70. As shown in FIGS. 3 and 9, the housing 70 defines a recess 170 configured to receive the cord 82.

Figure 6:
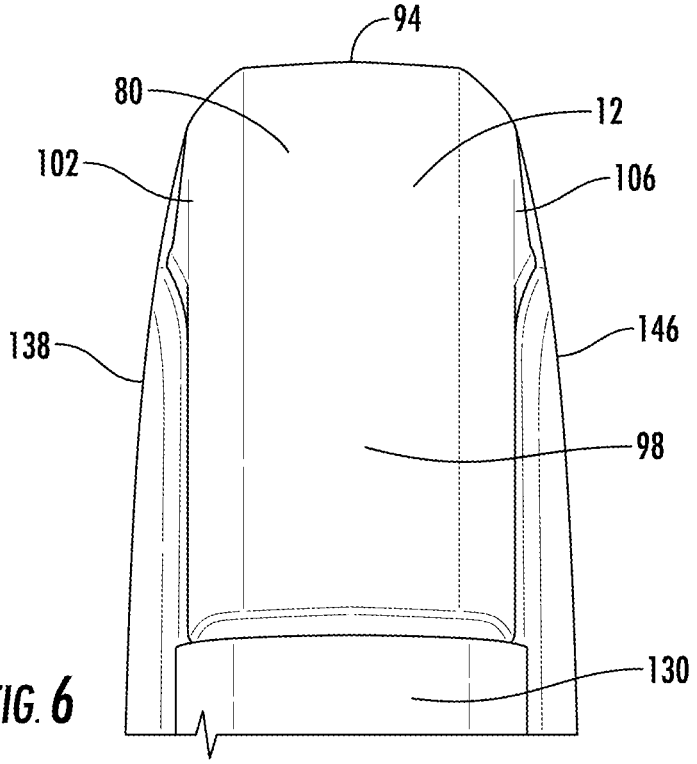
FIG. 6 is a plan view of the vacuum cleaner of FIG. 1.
Figure 7:
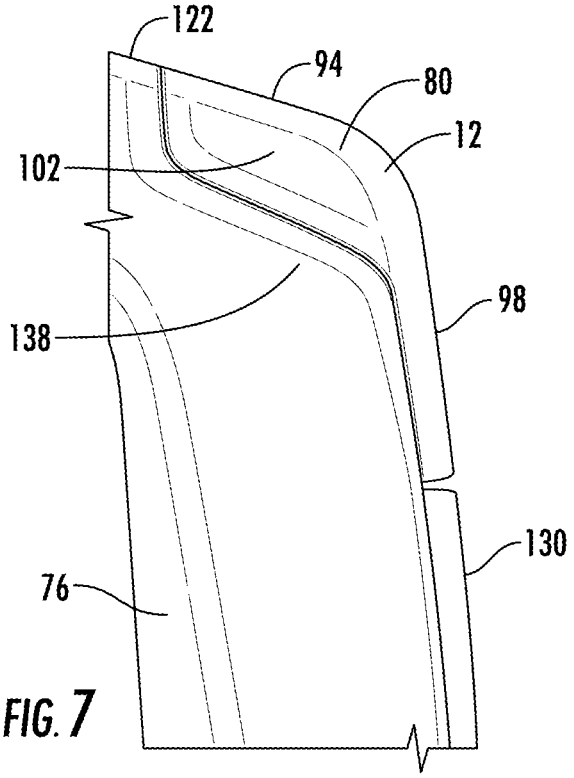
FIG. 7 is a plan view of the vacuum cleaner of FIG. 1.
Figure 10A:
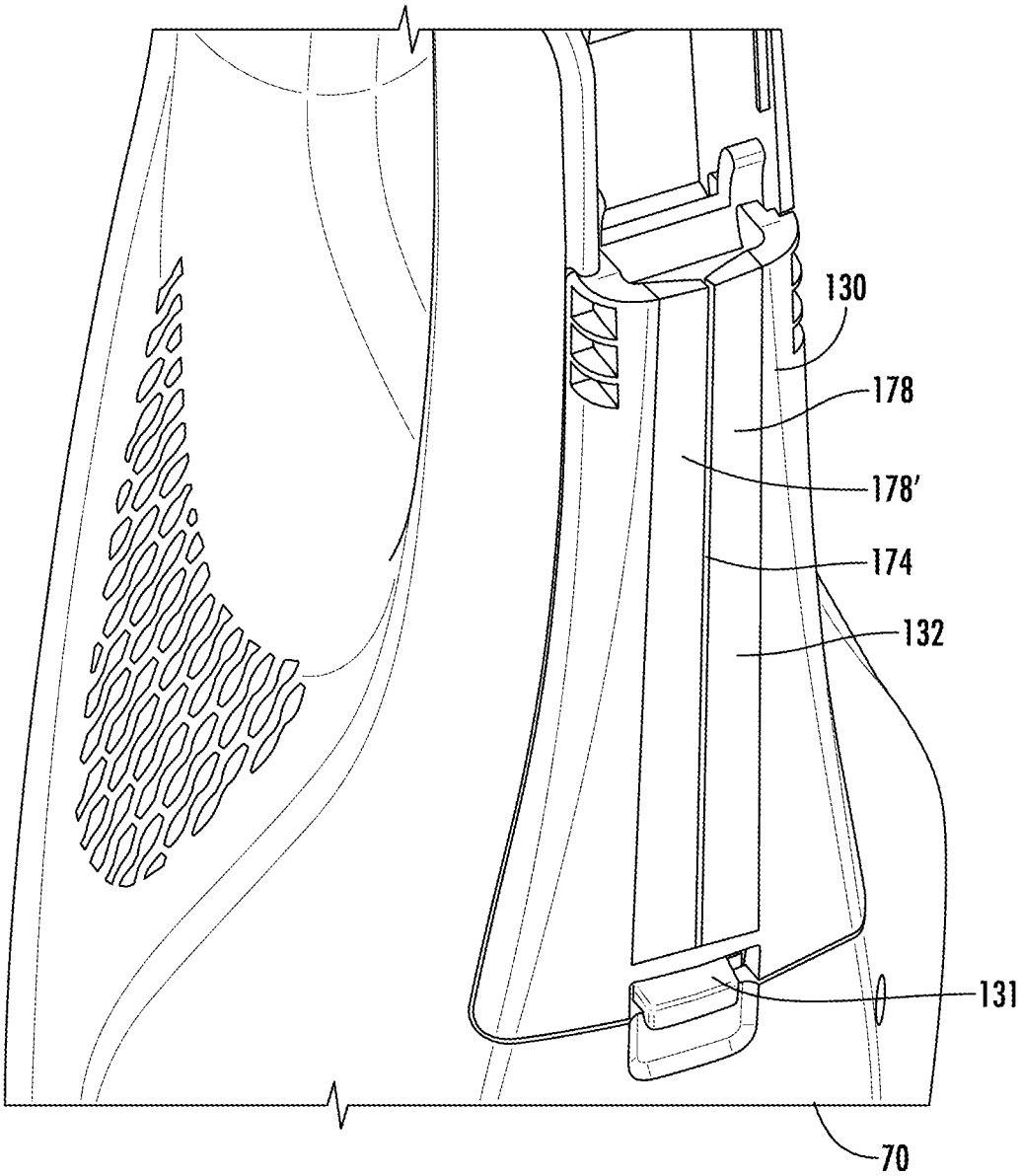
FIG. 10A is a perspective view of another embodiment of the vacuum cleaner of FIG. 1 with a plug assembly removed.
Figure 10B:
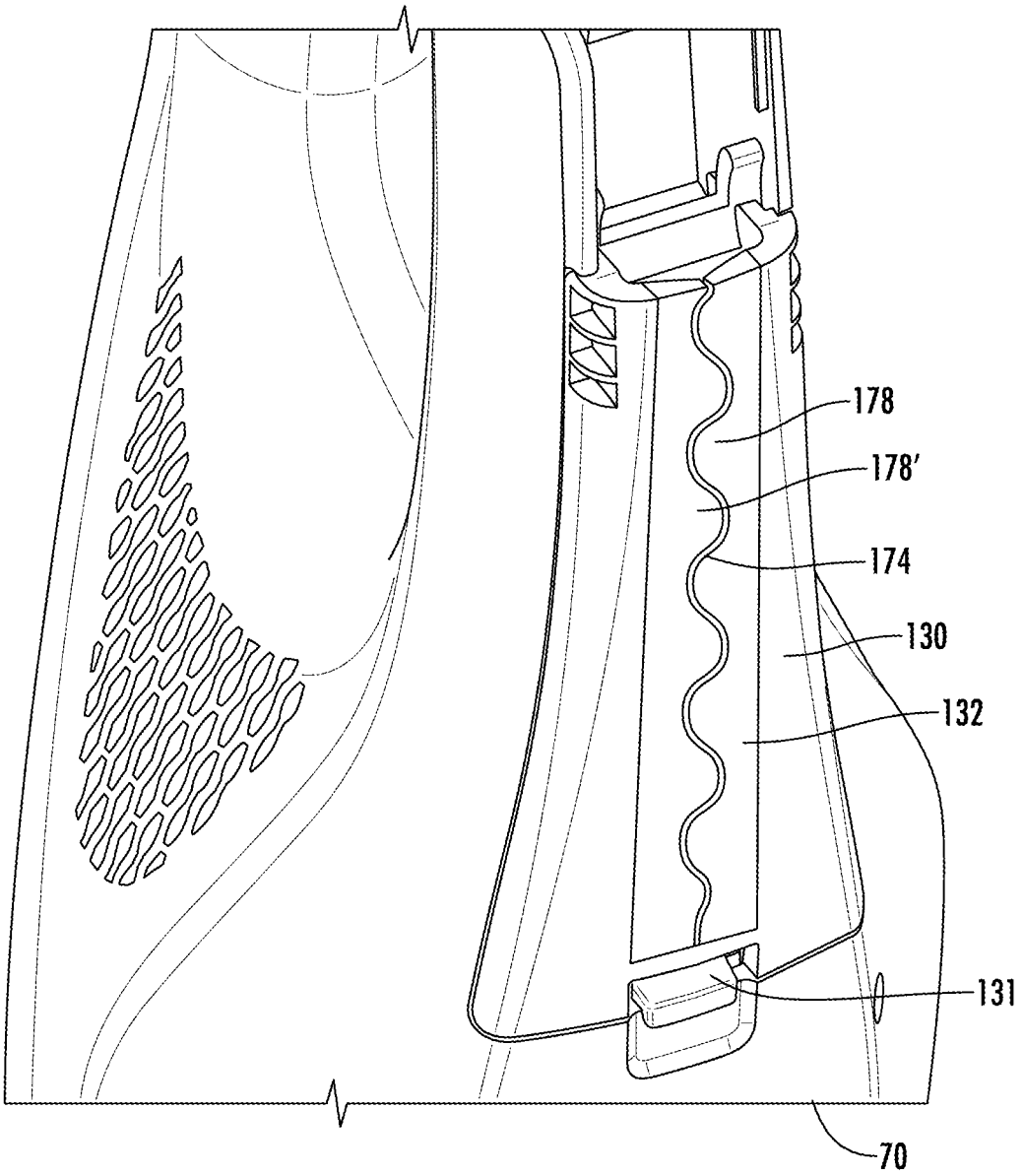
FIG. 10B is a perspective view of yet another embodiment of the vacuum cleaner of FIG. 1 with a plug assembly removed.

In the embodiment shown in FIGS. 6 and 7, an outer surface of the housing 70 around the access opening 87 may be identified by a first housing surface 122, a second housing surface 130, a third housing surface 138 and a fourth housing surface 146. In embodiments shown in FIGS. 10A and 10B, the second housing surface 130 includes an access door 132 openably attached to the housing 70. The access door 132 may slide, hinge, or otherwise move to open. The access door 132 formed by the second housing surface 130 is configured to be opened by an operator in order provide access to an interior of the recess 170 allowing the operator to position the cord 82 within the recess 170. The access door 132 further includes a latch or other attachment mechanism 131 configured to removably couple the second housing surface 130 to the housing 70 such as shown in FIGS. 10A and 10B.

In the illustrated embodiment, when the plug assembly 12 is in the second position, the body 80 of the plug assembly 12 forms an outer surface of the vacuum cleaner 10. As shown in FIG. 4, the housing 70 forms an enclosure or exterior portion of the cleaner 14, and when the plug assembly 12 is in the second position an outer body surface of the body 80 forms a portion of the outer surface of the enclosure. Stated another way, the vacuum cleaner 10 has a predetermined shape, and the outer surface of the housing 70 and the outer body surface cooperate to form at least a portion of the predetermined shape when the plug assembly 12 is in the second position.

In one embodiment, the outer body surface of the plug assembly 12 includes a first plug surface 94, a second plug surface 98, a third plug surface 102, and a fourth plug surface 106 (FIG. 6). In the embodiment shown in FIGS. 4, 6 and 7, when the plug 12 is in the second position, the first plug surface 94 is substantially continuous with the first housing surface 122, the second plug surface 98 is substantially continuous with the second housing surface 130, the third plug surface 102 is substantially continuous with the third housing surface 138, and the fourth plug surface 106 is substantially continuous with the fourth housing surface 146. "Substantially continuous" means that although there may be small gaps, divots, breaks, or divides between two portions and the surfaces may be offset, the portions are otherwise substantially contiguous. In other words, when the plug 12 is in the second position, one or more plug surfaces 94, 98, 102, 106 are substantially contiguous with one or more housing surfaces 122, 130, 138, 146. Thus, the outer surfaces of the plug body 80 integrate with the outer surfaces of the housing 70 and handle portion 76 to form a smooth appearance when the plug assembly 12 is in the second position. Also, the electrical connector 16 is concealed within the housing 70 when the plug assembly 12 is in the second position. Also, because the plug assembly 12 is received in the housing 70 in the second position it is less likely to be lost or separated from the vacuum.

Figure 12:
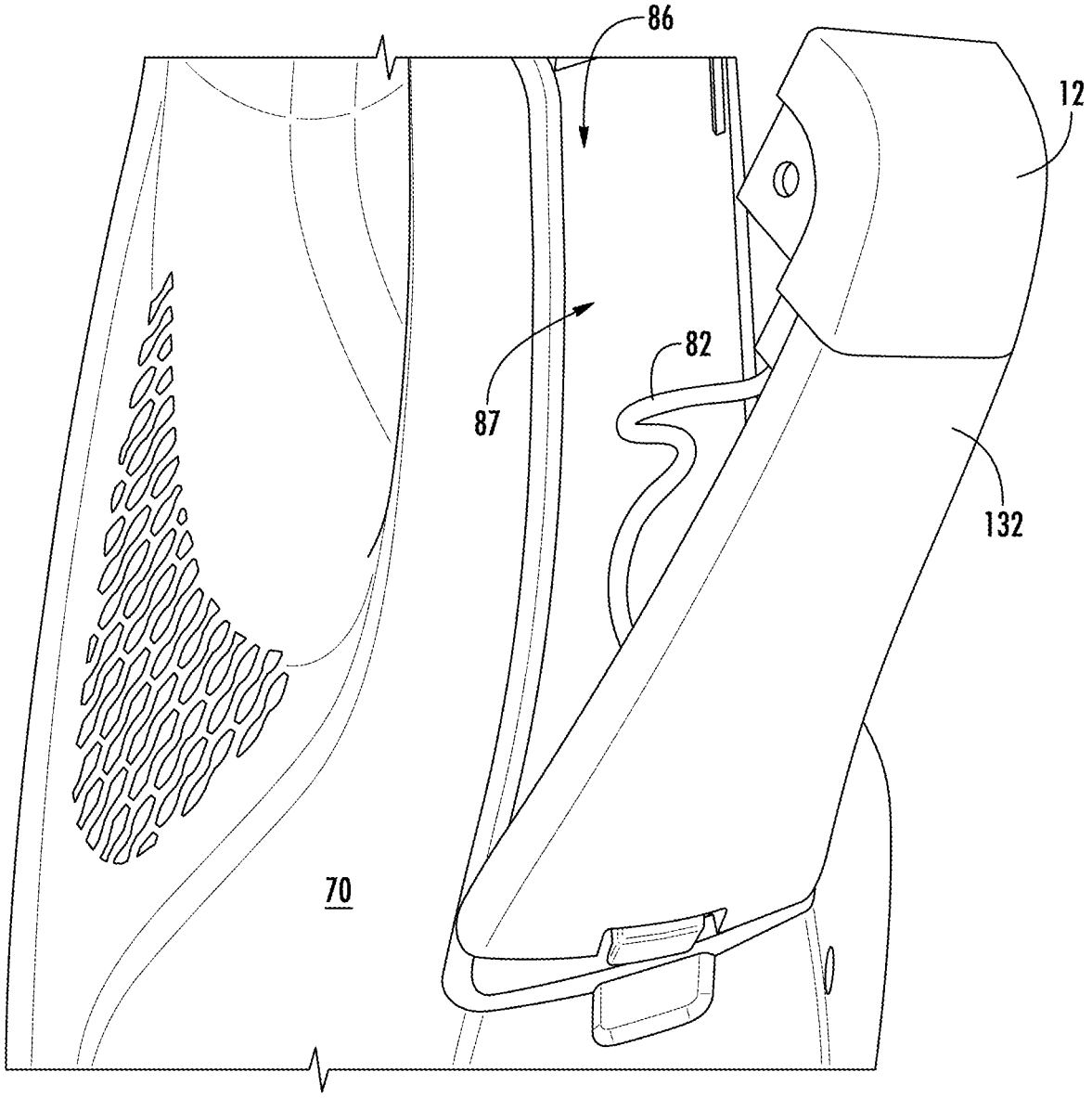
FIG. 12 is a perspective view of another embodiment of the vacuum cleaner of FIG. 11 with a plug assembly connected to an access door.

In the illustrated embodiment, the body 80 of the plug assembly 12 forms a cover over the access opening 87 when the plug assembly 12 is in the second position. In one alternative shown in FIG. 12, the plug assembly 12 is movable with the access door 132 between the first position in which the access door 132 is opened and the second position in which the door is closed. Optionally, the plug assembly 12 may be hidden by the access door 132. In yet another alternative, the plug assembly 12 is retained within the recess 86 but does not form a portion of the outer surface of the vacuum cleaner when the plug assembly 12 is in the second position.

The plug assembly 12 is retained within the recess 86. The plug assembly 12 and housing 70 may include one or more retaining or engaging portions to connect the plug assembly to the housing. In the illustrated embodiment, the housing 70 includes a first engagement member and the plug body 80 includes a second engagement member. The first engagement member and the second engagement member are configured to cooperatively engage to retain the plug assembly in the second position. In one example, one of the housing 70 and the plug body 80 includes a protrusion 162 and the other one of the housing and the body defines a recess 114, configured such that the protrusion 162 is received in the recess 114 when the plug assembly 12 is in the second position. Alternatively, the first and second engagement members may be first and second interlocking protrusions or tabs or hooks. Alternatively, one of the first and second engagement members may be a latch and the other a receiver. Additional retaining members may be provided.

Figure 8:
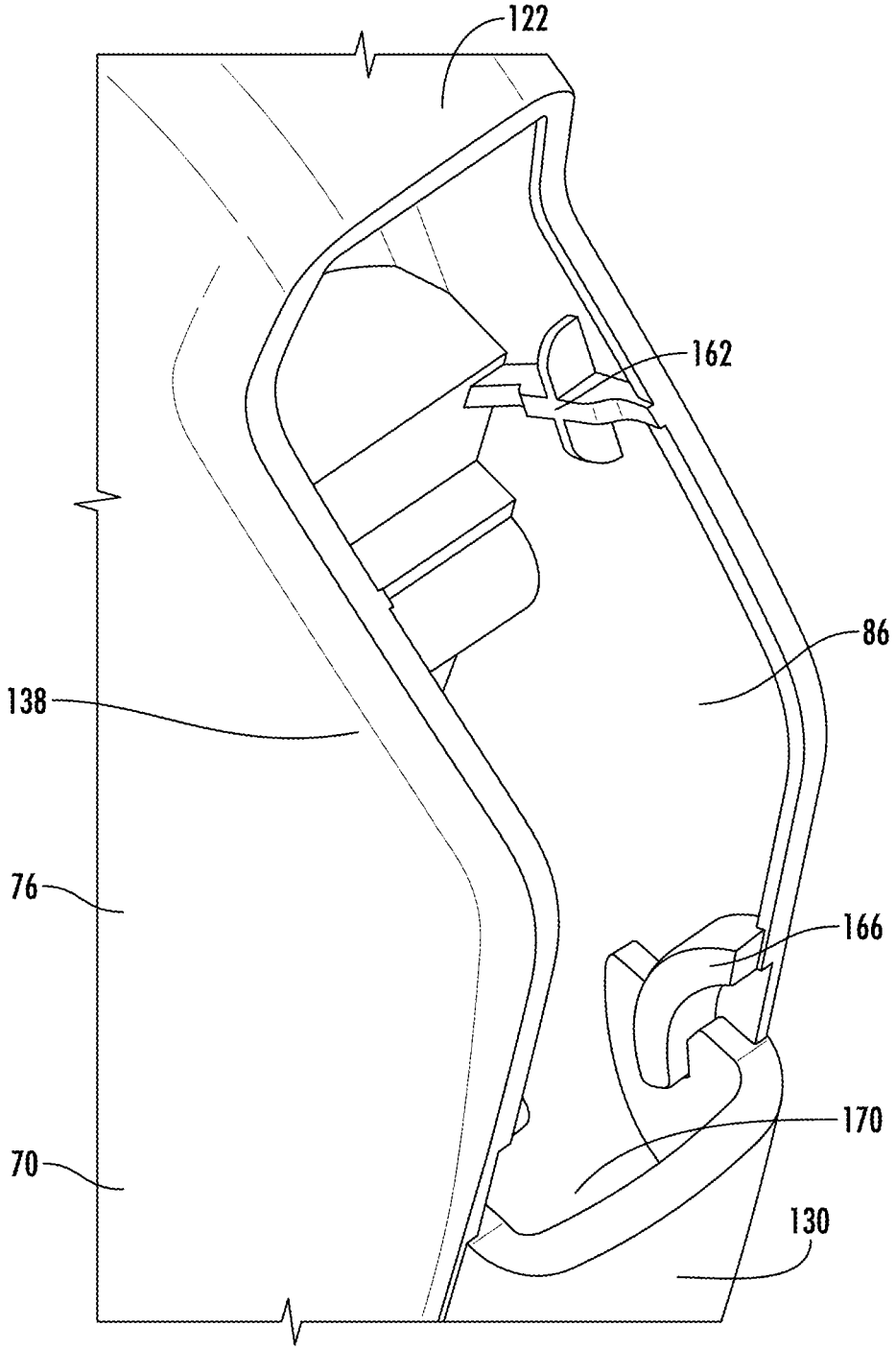
FIG. 8 is a perspective view of the vacuum cleaner of FIG. 1 with a plug assembly removed.

In the illustrated embodiment, a pair of protrusions 166 (only one shown) are provided on either the housing 70 or body 80 configured to be received within grooves 118 in the other of the housing 70 or plug body 80. As shown in FIGS. 5 and 8, the protrusions 166 on the housing 70 engage the groove 118 on the plug body 80 such that the plug assembly 12 is pivoted with respect to the housing 70 when the plug assembly moves from the first position to the second position and retained by engagement of the protrusion 162 in the recess 114.

The recess 170 is configured to receive the cord 82. The cord 82 is moveable out of and into the recess 170 as the plug 12 moves between the first and second positions. Optionally, the handheld cleaner 14 includes a cord reel or cord wrap (not shown) configured to organize the cord when the plug assembly 12 is in the second position, or a cord rewind mechanism to move the plug assembly 12 to the second position by retracting the cord 82.

In some embodiments, as shown in FIGS. 10A and 10B, the housing 70 includes a longitudinal slot 174 through the housing defining a pathway to the interior of the recess 170. The longitudinal slot 174 may be a linear slot as shown in FIG. 10A or may include curvilinear elements, such as shown by the example in FIG. 10B. In the embodiment of FIGS. 10A and 10B, the material forming one or both sides 178, 178' of the longitudinal slot 174 are formed by a resilient material. The resilient material is selected to be pliable such that the slot 174 may be enlarged by an operator, enabling the cord 82 to enter and exit the recess 170 without needing to travel through the recess 86. In some embodiments resilient material is over molded onto the housing 70 forming the slot 174. Optionally, the thickness of the resilient material along the sides 178, 178' is varied to increase pliability as desired. In use, the operator may simply press the cord 82 through the slot 174 to return the cord 82 to the recess 170. Specifically, as the cord 82 is pressed through the slot 174, the resilient sides 178, 178' flex out of the way to allow the cord 82 to pass through the slot 174. Once the cord 82 is in the recess 170, the resilient sides 178, 178' return to their original position closing the slot 174.

Figure 11:
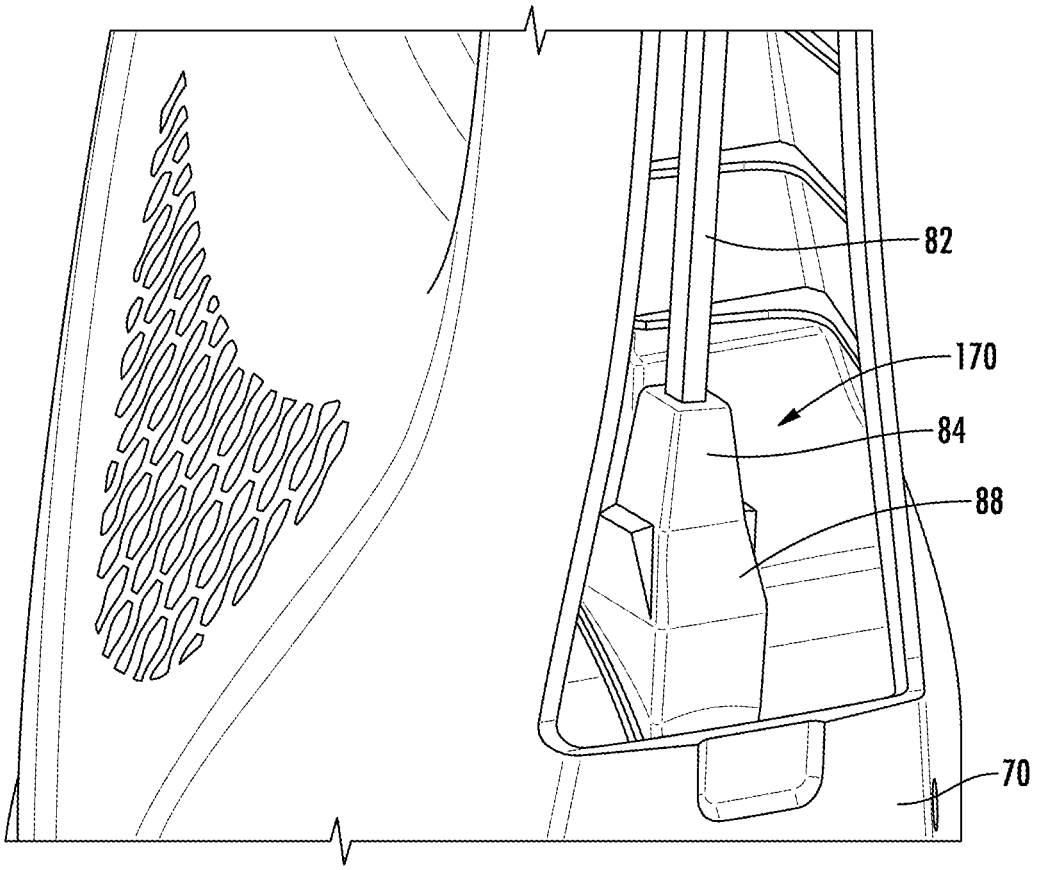
FIG. 11 is a perspective view of the vacuum cleaner of FIG. 1 with an access door removed.

As shown in FIG. 11, the proximal end 84 of the cord 82 couples to the housing 70 via a connector 88 to deliver electrical power from the cord 82 to recharge the batteries or power components of the vacuum 10. In one embodiment, the connector 88 is removably connected to the housing 70, where the connector 88, the cord 82, and the plug assembly 12 may be optionally detached from the housing 70. In an alternative embodiment, the connector 88 is permanently attached to the housing 70, wherein the cord 82 and plug 12 are hardwired to the housing 70.

In operation, the one or more batteries 74 may need recharging after a period of continuous use. Thus, the operator removes the plug assembly 12 from the housing 70 and plugs the electrical connector 16 into an AC power source, corresponding to the first position of the plug 12 described above. The AC power source provides electricity to charge the one or more batteries 74 via the cord 82. Once the one or more batteries 74 have been charged, the operator uses a cord reel or manually puts the cord 82 back into the recess 170. The operator puts the plug 12 back into the housing 70 by, in the illustrated embodiment, inserting the protrusions 166 into the groove 118 on the plug 12 and gradually pivoting the plug 12 into the recess 86 about the protrusions 166. Eventually the engagement members 114, 162 connect, thus snap-fitting the plug 12 in the housing 70 in the second position.

Although the invention has been described in detail with reference to certain preferred embodiments, integration of the body of the plug assembly into the housing as described herein may be applied to other battery powered cleaners, and variations and modifications exist within the scope and spirit of one or more independent aspects of the invention as described.

The invention claimed is:

1. A vacuum cleaner comprising:

a housing;

a suction source;

a dirt collection chamber in fluid communication with the suction source;

a battery to provide power to the suction source; and a plug assembly having a body and an electrical connector in electrical communication with the battery via a cord, the plug assembly configured to receive power from an AC power source to charge the battery;

wherein the plug assembly is moveable between a first position in which the plug assembly is outside the housing and a second position in which the plug assembly is received in the housing; and wherein when the plug assembly is in the second position, the body of the plug assembly forms an outer surface of the housing.

2. The vacuum cleaner of claim 1, wherein the plug assembly includes a power converter in electrical communication with the electrical connector configured to convert AC power from the AC power source to DC power to charge the battery, and wherein the plug assembly is connected to a distal end of the cord.

3. The vacuum cleaner of claim 1, wherein the housing includes an access opening to an interior of the housing, and wherein the body of the plug assembly forms a cover over the access opening when the plug assembly is in the second position.

4. The vacuum cleaner of claim 1, wherein the housing forms an enclosure having an outer housing surface, and wherein the body of the plug assembly includes an outer body surface, and wherein when the plug assembly is in the second position, the outer body surface forms a portion of the outer housing surface of the enclosure.

5. The vacuum cleaner of claim 4, wherein the enclosure has a predetermined shape, and wherein the outer body surface and the outer housing surface cooperate to form at least a portion of the predetermined shape when the plug assembly is in the second position.

6. The vacuum cleaner of claim 1, wherein the outer body surface is substantially continuous with the outer housing surface when the plug is in the second position.

7. The vacuum cleaner of claim 1, wherein the housing includes a first engagement member and the body includes a second engagement member, and wherein the first engagement member and the second engagement member are configured to cooperatively engage to retain the plug assembly in the second position.

8. The vacuum cleaner of claim 1, wherein the plug assembly is pivoted with respect to the housing when the plug assembly moves from the first position to the second position.

9. The vacuum cleaner of claim 1, wherein the electrical connector is concealed within the housing when the plug assembly is in the second position.

10. The vacuum cleaner of claim 1, wherein the housing further comprises a longitudinal slot through the housing defining a pathway to an interior of the housing.

11. The vacuum cleaner of claim 10, wherein one or both sides of the longitudinal slot are formed by a resilient material.

12. The vacuum cleaner of claim 10, wherein the housing further comprises a door configured to provide access to an interior of the housing; and wherein the longitudinal slot extends along at least a partial length of the door.

13. The vacuum cleaner of claim 10, wherein the housing includes a first recess for the plug assembly and a second recess for the cord, and wherein when the plug assembly is moved from the first position to the second position, the cord can move through the slot to the second recess without having to pass through the first recess.

14. The vacuum cleaner of claim 13, wherein one or both sides of the longitudinal slot are formed by resilient material.

15. The vacuum cleaner of claim 10, wherein the housing further comprises a door configured to provide access to an interior of the housing; and wherein the plug assembly is movable with the door between the first position in which the door is opened and the second position in which the door is closed.

16. A battery powered cleaner comprising:

a housing including a handle;

a suction source;

a suction inlet fluidly coupled to the suction source;

a dirt collection chamber;

a battery to provide power to the suction source; and a plug assembly having a body and an electrical connector in electrical communication with the battery via a cord, the plug assembly configured to receive power from an AC power source to charge the battery;

wherein the plug assembly is moveable between a first position in which the plug assembly is outside the handle and a second position in which the plug assembly is received in the handle; and wherein when the plug assembly is in the second position, the body of the plug assembly forms an outer surface of the handle.

17. The cleaner of claim 16, wherein the plug assembly includes a power converter in the body in electrical communication with the electrical connector configured to convert AC power from the AC power source to DC power to charge the battery; wherein the plug assembly is connected to a distal end of the cord.

18. The cleaner of claim 16, wherein the housing includes an access opening to an interior of the housing; and wherein the body of the plug assembly forms a cover over the access opening when the plug assembly is in the second position.

19. The vacuum cleaner of claim 16, wherein the handle forms an enclosure having an outer handle surface, and wherein the body of the plug assembly includes an outer body surface, and wherein when the plug assembly is in the second position, the outer body surface forms a portion of the outer handle surface of the enclosure.

20. The vacuum cleaner of claim 19, wherein the enclosure has a predetermined shape, and wherein the outer body surface and the outer handle surface cooperate to form at least a portion of the predetermined shape when the plug assembly is in the second position.

21. The cleaner of claim 16, wherein the housing further comprises a longitudinal slot through the housing defining a pathway to an interior of the housing.

22. A battery powered cleaner comprising:

a housing;

a motor operably positioned within the housing;

a battery to provide power to the motor; and a plug assembly having a body and an electrical connector in electrical communication with the battery via a cord, the plug configured to engage an AC power source to receive AC power and charge the battery;

wherein the plug assembly is moveable between a first position in which the plug assembly is outside of the housing and a second position in which the plug assembly is received in the housing;

wherein the housing defines a recess having an access opening, the recess configured to receive the cord and plug assembly in the second position;

wherein the plug assembly includes a power converter in the body in electrical communication with the electrical connector configured to convert AC power from the AC power source to DC power to charge the battery; and wherein the plug assembly is connected to a distal end of the cord.

23. The cleaner of claim 22, wherein the body of the plug assembly includes an outer body surface forming a portion of an outer surface of the housing when the plug assembly is in the second position.

24. The cleaner of claim 22, wherein the body of the plug assembly forms a cover over the access opening when the plug assembly is in the second position.

25. The cleaner of claim 22, further comprising a longitudinal slot through the housing defining a pathway to an interior of the recess.

26. The cleaner of claim 25, wherein one or both sides of the longitudinal slot are formed by a resilient material.

* * * * *